US007040267B2

(12) United States Patent
Duesmann

(10) Patent No.: US 7,040,267 B2
(45) Date of Patent: May 9, 2006

(54) FULLY VARIABLE MECHANICAL VALVE GEAR FOR A PISTON-TYPE INTERNAL COMBUSTION ENGINE

(75) Inventor: Markus Duesmann, Stolberg (DE)

(73) Assignee: FEV Motorentechnik GmbH, Aachen (DE)

( * ) Notice: Subject to any disclaimer, the term of this patent is extended or adjusted under 35 U.S.C. 154(b) by 190 days.

(21) Appl. No.: 10/612,345

(22) Filed: Jul. 3, 2003

(65) Prior Publication Data

US 2004/0103865 A1 Jun. 3, 2004

Related U.S. Application Data

(63) Continuation of application No. PCT/EP02/00006, filed on Jan. 2, 2002.

(30) Foreign Application Priority Data

Jan. 4, 2001 (DE) ..... 101 00 173

(51) Int. Cl.
*F01L 1/00* (2006.01)

(52) U.S. Cl. ..... 123/90.2; 123/90.15; 123/90.16; 123/90.6

(58) Field of Classification Search ..... 123/90.16, 123/90.15, 90.44, 90.6, 90.2
See application file for complete search history.

(56) References Cited

U.S. PATENT DOCUMENTS 4,572,118 A 2/1986 Baguena
5,119,773 A 6/1992 Schön et al.
5,370,090 A * 12/1994 Murata et al. ..... 123/90.16
5,619,965 A * 4/1997 Cosma et al. ..... 123/322

FOREIGN PATENT DOCUMENTS

DE 23 35 632 A 1/1975
DE 90 12 934 U 12/1990

* cited by examiner

*Primary Examiner*—Thomas Denion
*Assistant Examiner*—Zelalem Eshete
(74) *Attorney, Agent, or Firm*—Venable LLP; Robert Kinberg; Steven J. Schwarz

(57) ABSTRACT

The invention relates to a variably adjustable mechanical valve gear for at least one gas-reversing valve (1) provided with a closing spring (2) on a piston-type internal combustion engine having a drive mechanism (13) for generating a lifting movement that is effective counter to the force of the closing spring (2) on the gas-reversing valve (1) and with a stroke transfer means (4) in the form of a pivoting element (8), arranged between the driving mechanism (13) and the gas-reversing valve (1), which acts upon the gas-reversing valve (1) in the direction of its movement axis (14) and for which the lifting distance in the direction of the movement axis (14) can be changed via an adjustable guide element (11), wherein the pivoting element is connected to the gas-reversing valve with its end that is effective in the direction of the movement axis (14) and to the driving mechanism (13) with its end opposite the gas-reversing valve (1) and is guided to pivot back and forth on the guide element (11) designed as control curve (11.1).

18 Claims, 9 Drawing Sheets

FULLY VARIABLE MECHANICAL VALVE GEAR FOR A PISTON-TYPE INTERNAL COMBUSTION ENGINE

CROSS-REFERENCE TO RELATED APPLICATION

This is a continuation of PCT Application No. PCT/EP02/00006, filed Jan. 2, 2002, which claims the priority of German Patent Application No. 101 00 173.8 filed Jan. 4, 2001, the subject matter of which is incorporated herein by reference.

BACKGROUND OF THE INVENTION

With piston-type internal combustion engines operated based on the Otto cycle, the load is controlled via a throttle in the air-intake system, which causes considerable performance losses during the partial-load operation.

By using a so-called fully variable valve gear, a load control without a throttle is possible for piston-type internal combustion engines of this type. Fully variable valve gear operation means not only that the phase position of the valve opening and the valve closing can be changed in dependence on the crankshaft position, but the valve stroke itself can also be changed. As a result, a considerable performance improvement can be achieved and the hydrocarbon, carbon monoxide and in part also the nitrogen oxide emissions can be lowered.

A fully variable valve gear control of this type is possible, for example, with electromagnetic valve gears since these can be purposely activated to control the start and end of the valve opening as well as the valve stroke within the limits set by the Otto cycle by using an electronic engine control and corresponding control programs and by taking into account performance characteristics.

Reference DE-A-199 04 840 discloses a valve gear with mechanical adjustment of the stroke displacement, which comprises a driving mechanism embodied as a crank, which is provided with a pressure lever that can be operated transverse to the movement direction of the valve to be activated. The pressure lever rests approximately with the center of its longitudinal extension via a roll on the tappet of the valve to be activated and with its free end supports itself via a roll on a lever-type, hinged control curve that can be pivoted with the aid of an adjustment mechanism. As a result of the geometric allocation of the individual elements relative to each other, the known valve gear permits only a limited stroke adjustment.

A valve adjustment mechanism for internal combustion engines is known from DE-A-23 35 632, for which the free end of the valve shaft for the gas-reversing valve to be activated is provided with a bowl cup that holds the tappet end provided with a corresponding ball dome. The tappet end facing away from the gas-reversing valve is connected via a knee joint and a crank rocker, essentially aligned perpendicular to the movement axis of the gas-reversing valve, which is positioned with its end on the pivot of a crank mechanism, so that the movement which is tapped essentially horizontal at the crankshaft is translated into a vertical movement. The knee joint is provided with a roll that moves across an approximately spiral guide track which can pivot around a pivoting axis and can be swiveled via an adjustment mechanism relative to the orientation of the movement axis for the gas-reversing valve, so that depending on the position of the guide track, the valve lift is increased or reduced. There is no reference to presetting a "zero lift."

Reference U.S. Pat. No. 5,119,773 discloses a valve adjustment mechanism for internal combustion engines where an essentially triangular sliding body provided with a control curve is arranged with its tip between an activation cam and an adjustment roll that can be adjusted relative to the activation cam, wherein the tip acts upon the free end of the gas-reversing valve to be activated. The valve lift is generated in that the tip of the sliding body is pressed during the operation by the activation cam against the adjustment roll and, corresponding to the settings predetermined through the control curve of the adjustment roll and the distance between the adjustment roll to the activation cam is pushed in the direction of the gas-reversing valve. A "zero lift" cannot be preset. The lift adjustment occurs through a change in the distance between the activation cam on the one hand and the adjustment roll on the other hand.

SUMMARY OF THE INVENTION

It is the object of the present invention to create for at least one gas-reversing valve on a piston-type engine, in particular a piston-type internal combustion engine, a valve gear with a mechanical adjustment option that allows a stroke displacement adjustment from "zero stroke" to "full stroke."

This object is solved according to the invention with a variably adjustable mechanical valve gear for at least one gas-reversing valve provided with a closing spring on a piston-type engine, in particular a piston-type internal combustion engine, with a driving mechanism for generating a lifting movement that acts counter to the force of the closing spring on the gas-reversing valve, with a stroke-transfer means arranged between the driving mechanism and the gas-reversing valve that acts upon the gas-reversing valve in the direction of its movement axis and for which the stroke distance can be changed in the direction of the movement axis via an adjustable guide element in the form of a pivoting element. With its end facing away from the gas-reversing valve, it is connected to the driving mechanism and is guided so as to pivot back and forth on the guide element designed as control curve while it is positioned on a locally fixed guide with the end that acts upon the gas-reversing valve in the direction of the movement axis of the gas-reversing valve.

Whereas the driving mechanism of a know mechanical valve gear acts directly upon the shaft end of the gas-reversing valve to be actuated, the solution according to the invention calls for a mechanical stroke transfer means having an adjustable guide element between the driving mechanism and the gas-reversing valve, which can be used to influence the stroke characteristic with respect to the opening as well as the opening stroke. This solution makes it possible to design even conventional mechanical valve gears, i.e. cam drives, as fully variable valve gears. The force for the pivoting movement is triggered by the driving mechanism while the stroke characteristic is determined by a corresponding position of the guide element that forms the control curve. The control curve can be designed such that on the one hand the driving mechanism operating at full stroke, i.e. a cam drive, a crank mechanism, an electromagnetic or hydraulic actuator, transfers its full stroke to the pivoting element and, on the other hand, no valve opening occurs as a result of the respective design of the control curve, despite the full pivoting movement of the pivoting element. By adjusting the control curve, any stroke position can thus be adjusted between a "zero stroke" and a "maximum stroke" without changing the lift of the driving mechanism. With correspondingly high adjustment speeds for the guide element or with a corresponding design of the control curve, it is also possible to vary the lift during a piston stroke, i.e. having a dual opening and closing during an intake stroke.

It is useful in this connection if the force axis of the driving mechanism is at an angle to the movement axis of the gas-reversing valve, so that the desired changes with respect to the stroke characteristic can be effected via the joint operation of the stroke transfer means that is effective in the direction of the gas-reversing valve movement axis and the adjustable guide element. As a result, it is also ensured that the pivoting element always makes contact with the control curve.

According to the invention, the stroke-transfer means can be connected via a pivoting lever to the gas-reversing valve or, according to another embodiment, via a sliding guide extending in the direction of the movement axis for the gas-reversing valve to the gas-reversing valve.

One useful embodiment provides that the guide element on the stroke transfer element is positioned such that it can pivot around an axis oriented transverse to the movement axis of the gas-reversing valve.

The invention is explained in further detail with the aid of schematic drawings of exemplary embodiments.

DETAILED DESCRIPTION OF THE INVENTION

Figure 1:
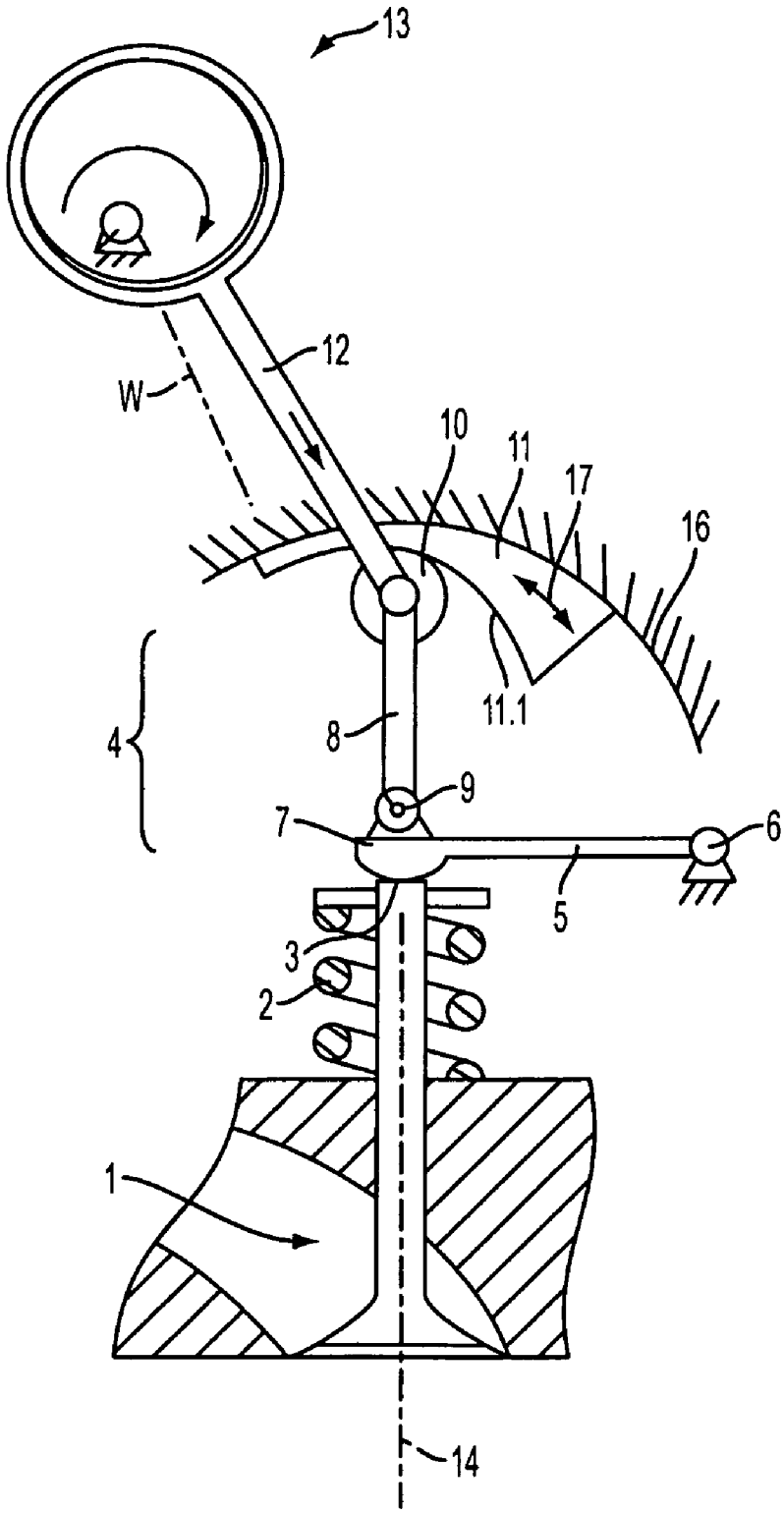
FIG. 1 shows a gas-reversing valve with a crank eccentric as a driving mechanism and with a pivoting lever guide.

The valve gear shown schematically in FIG. 1 essentially consists of a gas-reversing valve 1, which is held in the closed position via a valve spring 2. A stroke-transfer means 4 is allocated to the free end 3 of the valve shaft for the gas-reversing valve 1. For the exemplary embodiment shown herein, the stroke-transfer means essentially consists of a pivoting lever 5 that is positioned locally fixed on the engine unit with a bearing 6 or is supported by a valve play compensation means 6.1 (FIG. 10) and which rests with its other end 7 on the shaft end 3 of the gas-reversing valve 1. At a distance to the bearing 6, i.e. at the end 7 of the pivoting lever 5, a pivoting arm 8 is attached via a link 9 that is provided with a guide roll 10 on the end opposite the link 9. The guide roll 10 rolls off a guide element 11, positioned adjustable on the engine unit, which is designed as control curve for the exemplary embodiment shown herein. The function and mode of operation of the guide element will be explained further in the following.

A crank rocker arm 12 is hinged to the pivoting arm 8 and is connected to a crank eccentric 13 as driving mechanism. The driving mechanism, in this case the crank eccentric 13, is positioned such that its resulting force line of action W extends at an angle to the longitudinal axis 14 of the gas-reversing valve shaft and then to its movement axis. The guide element 11 that is designed as control curve is embodied to assume various adjustment positions around a locally fixed pivoting axis that is oriented transverse to the movement axis 14. This is shown, for example, with a circular sliding path 16. For the exemplary embodiment shown, the pivoting axis coincides with the axis for the link 9 during the closed position of the gas-reversing valve 1. The guide element 11 is connected to an adjustment drive that is not shown further herein, so that the position of the control curve can be adjusted in the direction of arrow 17 and thus can be changed with respect to its orientation toward the movement axis 14.

Figure 2:
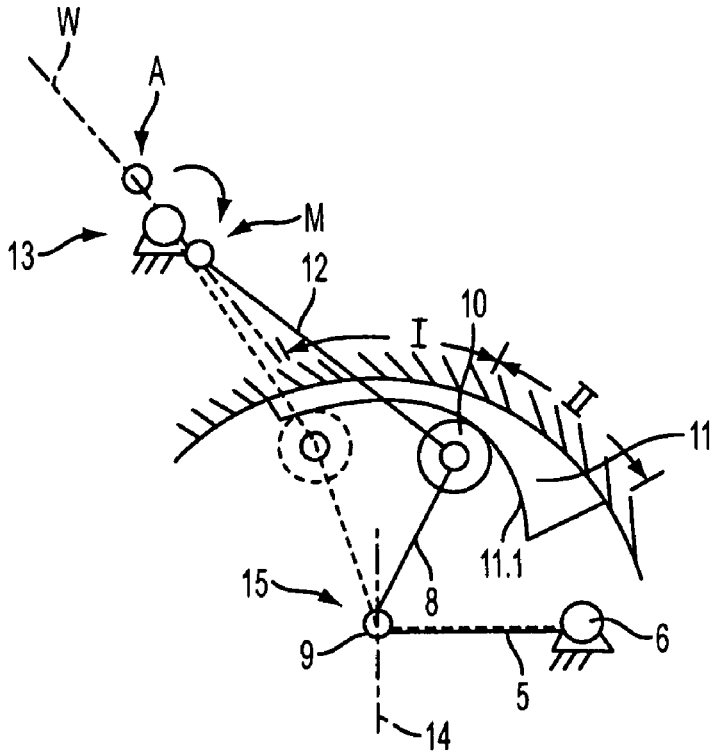
FIG. 2 is a basic representation of the embodiment according to FIG. 1, showing the "zero stroke" adjustment.

The control curve track 11.1 on which the roll 10 rolls off describes a basic circle, as shown in FIG. 2, which forms a "zero stroke zone" I, so that with a pivoting movement of the pivoting arm 8, a lifting movement for the gas-reversing valve 1 is not realized, despite a full stroke of the driving mechanism 13.

Figure 3:
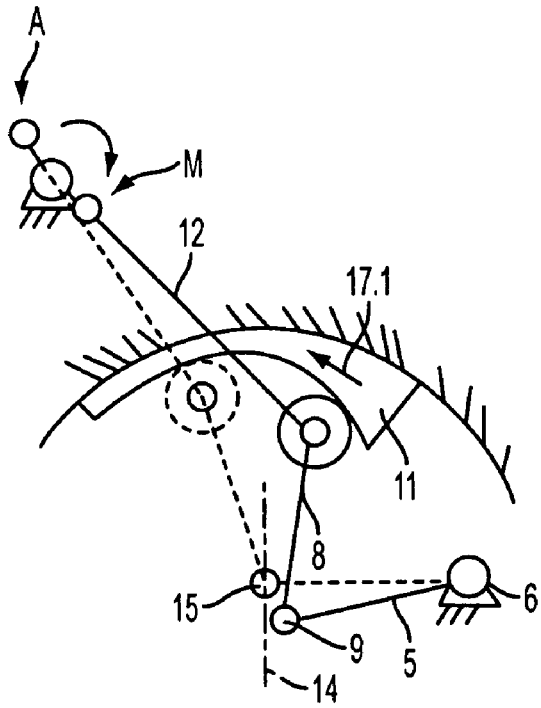
FIG. 3 is a basic representation according to FIG. 2 for a full stroke adjustment.

A "stroke zone" II with a constantly increasing curvature, for example, follows this "zero stroke zone" I, so that with a constant stroke displacement of the driving mechanism, in this case the crank eccentric 13, a stroke distance with increasing stroke displacement can be adjusted for the gas-reversing valve 1 between a "zero stroke" and a "maximum stroke." The transition between zone I and zone II should be designed such that a non-jerking movement is introduced during the rollover, which is explained further with the aid of FIGS. 2 and 3.

In FIG. 2, the guide element 11 with its guide path 11.1 is designed in such a way and with respect to the movement axis 14 is adjusted such that with a rotation of the eccentric crank 13 of 180° from the starting position A to the maximum stroke position M, the guide roll 10 rolls off the "zero stroke zone" I of the guide path 11.1 without the pivoting lever 5 generating a stroke. It means that the traversed region of the guide path 11.1 takes the form of a circle with respect to the axis 15 that coincides in this position with the link 9. This full stroke zone can also be an "imaginary" basic circle, meaning the roll 10 does not make contact with the guide element 11 in this region. The contact occurs only with a corresponding adjustment of the guide element 11, wherein the region for entering the stroke zone II must be designed such that the roll 10 essentially rolls without impact onto the contour.

If, as shown in FIG. 3, the guide element 11 is displaced from the position shown in FIG. 2 in the direction of arrow 17.1 to the position shown in FIG. 3 and the eccentric crank 13 is turne by 180° from the stroke position A to the stroke position M, the guide roll 10 at least partially rolls off the "stroke zone" II, in accordance with the design of the guide path 11.1, so that a stroke with corresponding stroke displacement is transmitted and the gas-reversing valve 1 is opened. FIG. 3 shows the positioning of the guide element 11 for the maximum stroke.

It is easy to see that any optional stroke displacement between the zero stroke shown in FIG. 2 and the maximum stroke shown in FIG. 3 can be preset through a respective adjustment of guide element 11 and a corresponding actuation of the adjustment mechanism for the guide element 11.

In that case, the valve stroke phase position with respect to the crankshaft position can also be effected via a relative adjustment of the eccentric shaft on the whole, as is well known.

Figure 4:
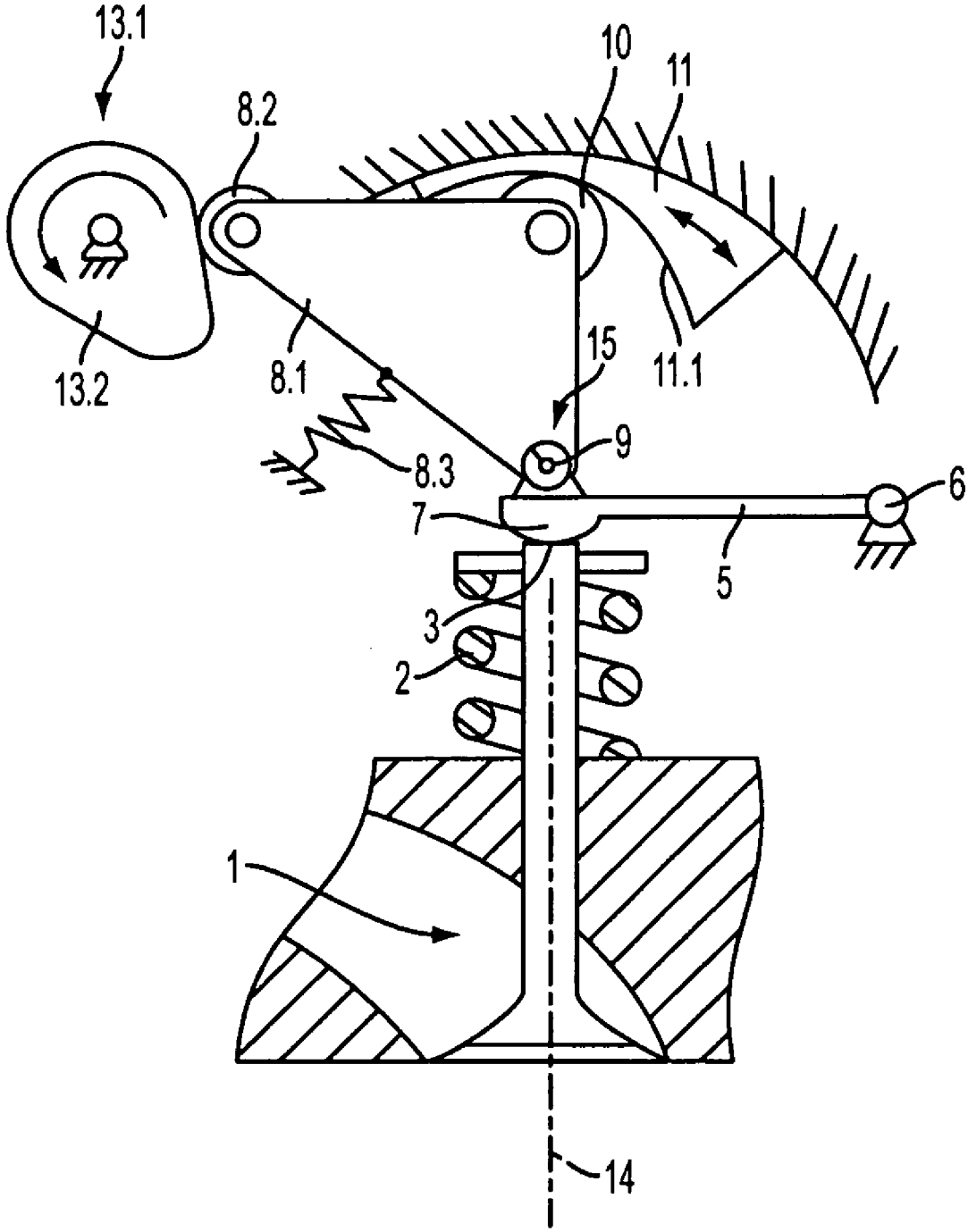
FIG. 4 shows an exemplary embodiment for a driving mechanism in the form of a cam shaft.

If a standard camshaft 13.1 is to be used in place of the driving mechanism in the form of a crank or eccentric shaft, a pivoting element 8.1 that is in turn connected via a link 9 to the pivoting lever 5 must be provided according to FIG. 4 in place of the pivoting arm 8. The pivoting element 8.1, in turn, is provided with a guide roll 10 in the region facing the guide element 11. The pivoting element is provided with a pressure roll 8.2 in the region facing the drive cam 13.2, so that during one rotation of the cam 13.2, the pivoting movement of pivoting element 8.1, induced by the cam, can be converted in dependence on the position of the guide element 11 from a zero stroke to at most the maximum stroke of the gas-reversing valve.

However, instead of having a guide element 11 that performs a circular movement along a path with central point 15, it is also possible to design the guide element 11 such that it performs a translational movement crosswise to the movement axis 14, provided the control curve 11.1 is designed correspondingly.

Figure 5:
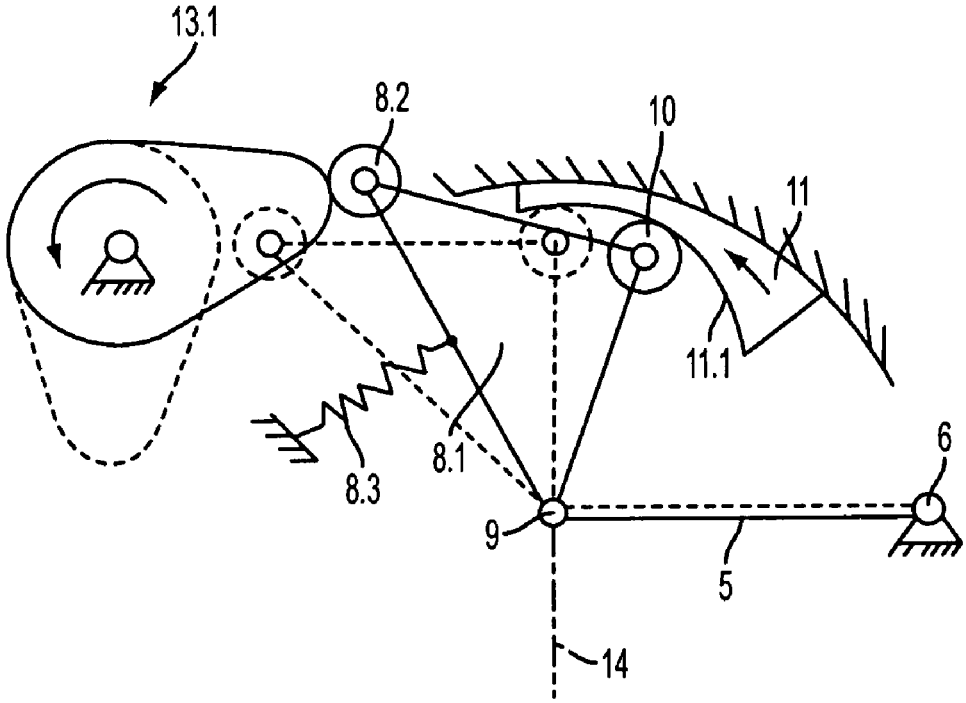
FIG. 5 is a basic representation of the exemplary embodiment according to FIG. 4 for a "zero stroke."
Figure 6:
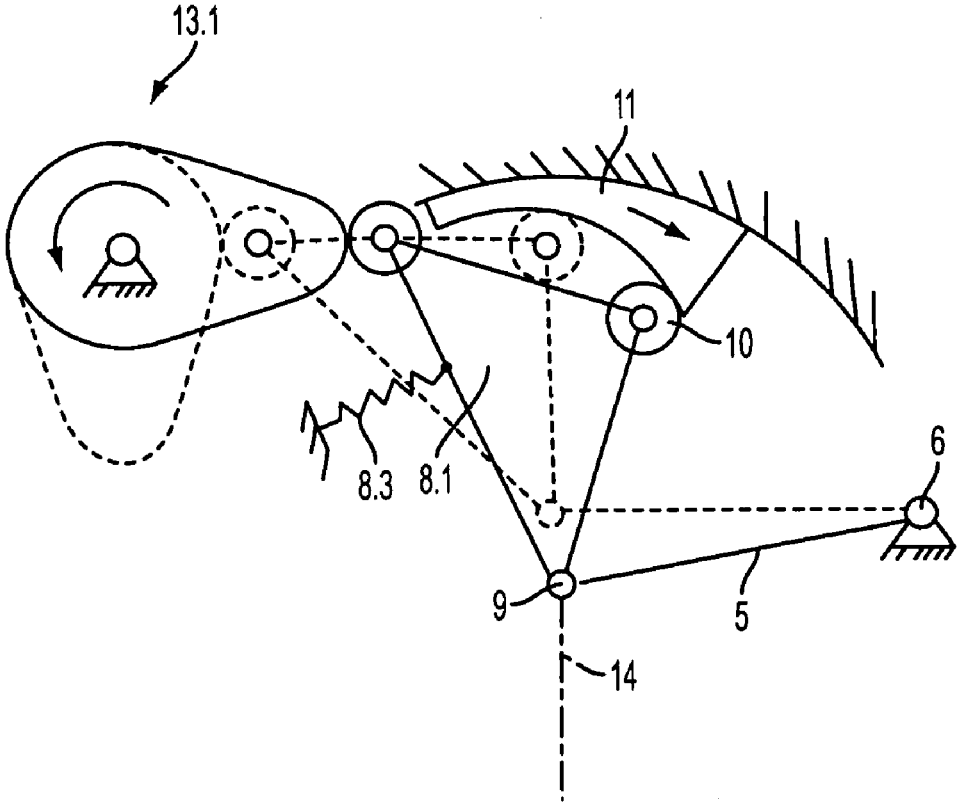
FIG. 6 is a basic representation according to FIG. 5 for a full-stroke adjustment.

The operation of the exemplary embodiment according to FIG. 4 is shown with the aid of FIG. 5 for a zero stroke and with the aid of FIG. 6 for a maximum stroke. The mode of operation corresponds to that described with the aid of FIGS. 2 and 3, so that we can point to it since the drawings are self-explanatory. The reliable contact between the guide roll 10 and the cam 13.2 is ensured with the restoring spring 8.3.

Figure 7:
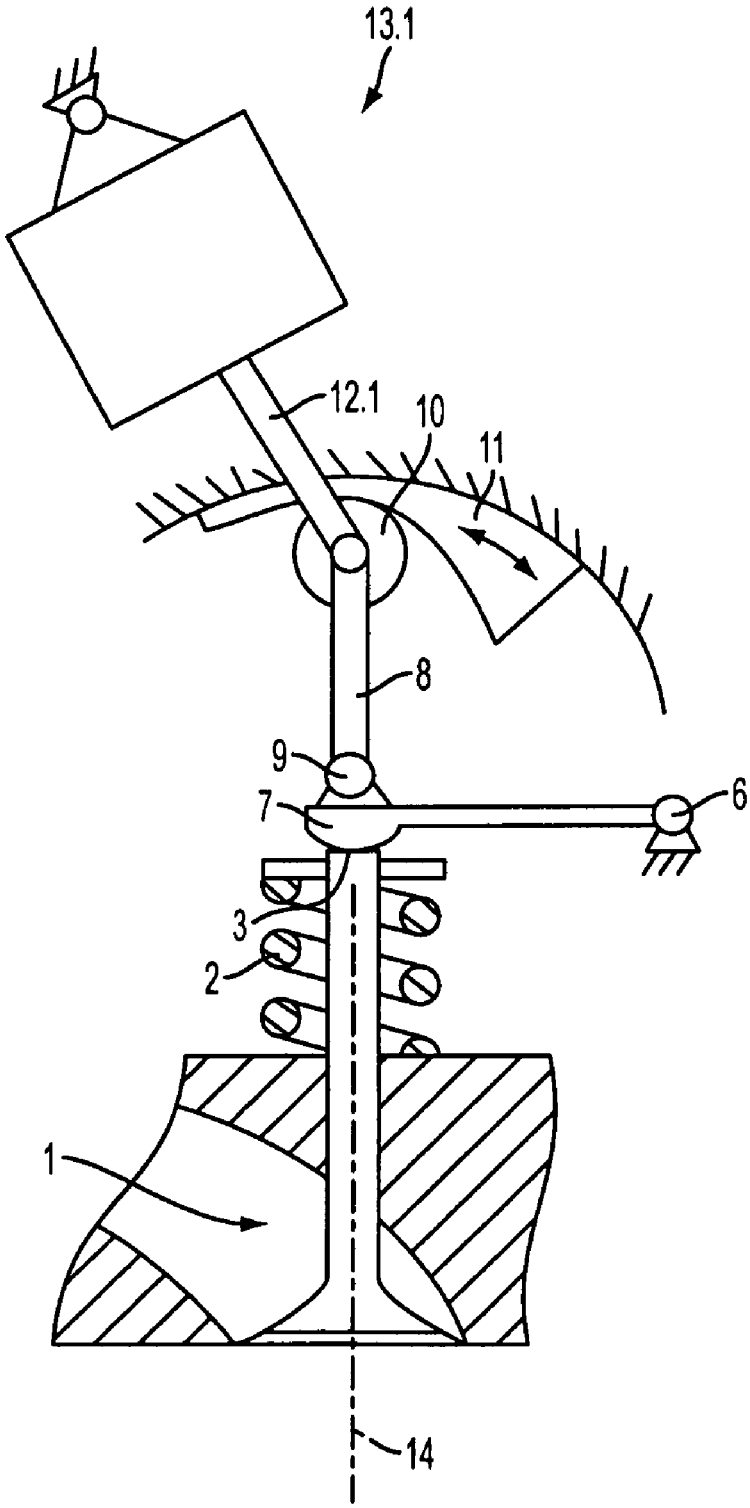
FIG. 7 shows the exemplary embodiment shown in FIG. 1 with a hydraulic or electromagnetic drive mechanism.

FIG. 7 shows an embodiment according to FIG. 1, having a driving mechanism 13.1 that is an electromagnetic or a hydraulic actuator in the form of a piston-cylinder-unit with a generally known design, wherein the actuator is shown only schematically. The actuator is provided with a push rod 12.1 that is connected to the pivoting arm 8 and works in the same way as the crank rocker 12 shown in FIG. 1. The desired back and forth movement for converting to a pivoting movement of the pivoting arm 8 can thus be generated by alternately supplying the actuator with electrical energy or with pressure energy.

As described with the aid of FIG. 1, FIG. 2 and FIG. 3, the change in the gas-reversing valve stroke is effected through an adjustment of the guide element ii.

Figure 8:
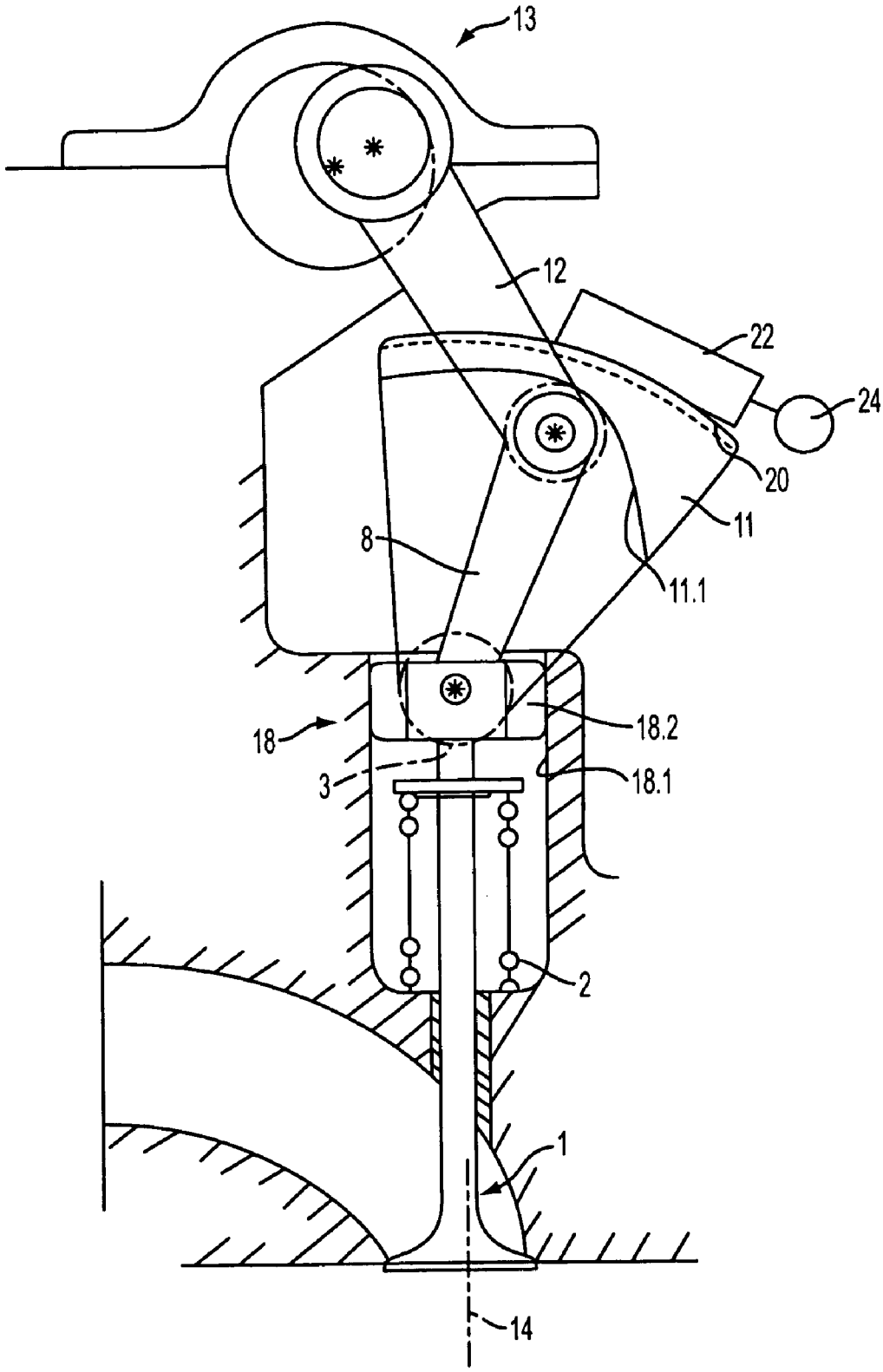
FIG. 8 shows a variation of the embodiment shown in FIG. 1, with a crank eccentric as driving mechanism and a sliding guide.

FIG. 8 shows an exemplary embodiment where the free end 3 of the gas-reversing valve 1 operates jointly with a sliding guide 18 instead of with a pivoting level 5. This sliding guide, which acts in the manner of a crosshead, consists of a locally fixed guide track 18.1 to which a sliding body 18.2 is assigned. According to the 'embodiment' shown in FIG. 1, a pivoting arm 8 is hinged to the sliding body and acts upon the shaft end 3 of the gas-reversing valve 1.

Otherwise, the design corresponds to the embodiment shown in FIG. 1. The guide element 11 in the form of a rocker arm, with its guide path 11.1 embodied as a control curve, in this case is also positioned on the engine unit, so as to pivot around a locally fixed pivoting axis, and can be adjusted via an adjustment mechanism with respect to the orientation of the guide track, 11.1 to the movement axis 14 of the gas-reversing valve 1. With the aid of roll 10 and the crankshaft rocker arm 12 that is hinged to the pivoting arm 8, a stroke can then be transferred via a crank mechanism 13 to the stroke-transfer means 4 and, corresponding to the position of guide means 11, via the guide path 11.1 to the gas-reversing valve 1, as previously described with the aid of FIGS. 2 and 3.

Figure 9:
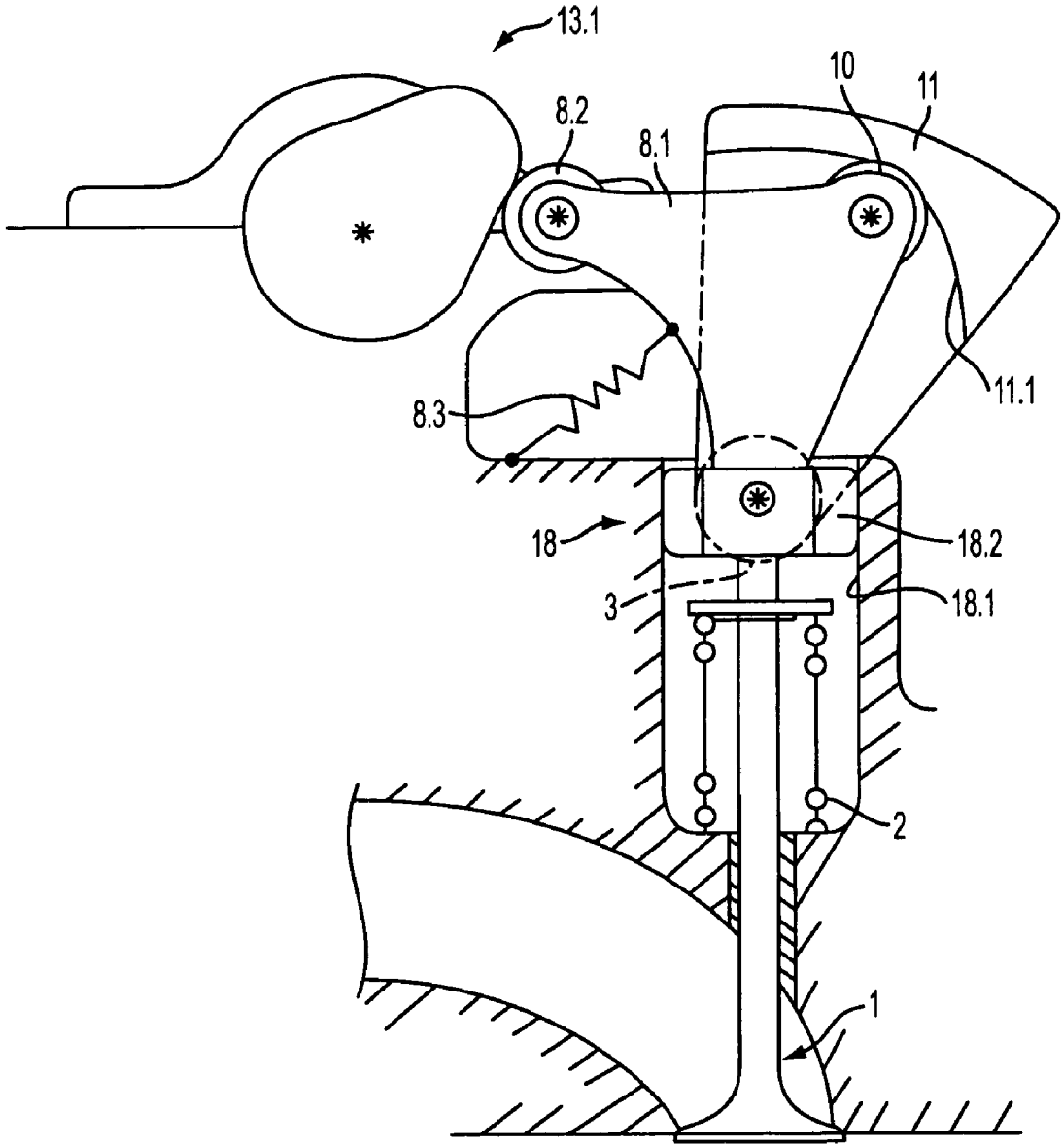
FIG. 9 shows the embodiment according to FIG. 8 with a cam drive.

FIG. 9 shows a modified version of the embodiment according to FIG. 8 for a mechanism in the form of a cam mechanism 13.1. The embodiment according to FIG. 8 can be actuated in the same way via an electromagnetic or hydraulic actuator designed as piston-cylinder unit, as described in connection with FIG. 7.

Figure 10:
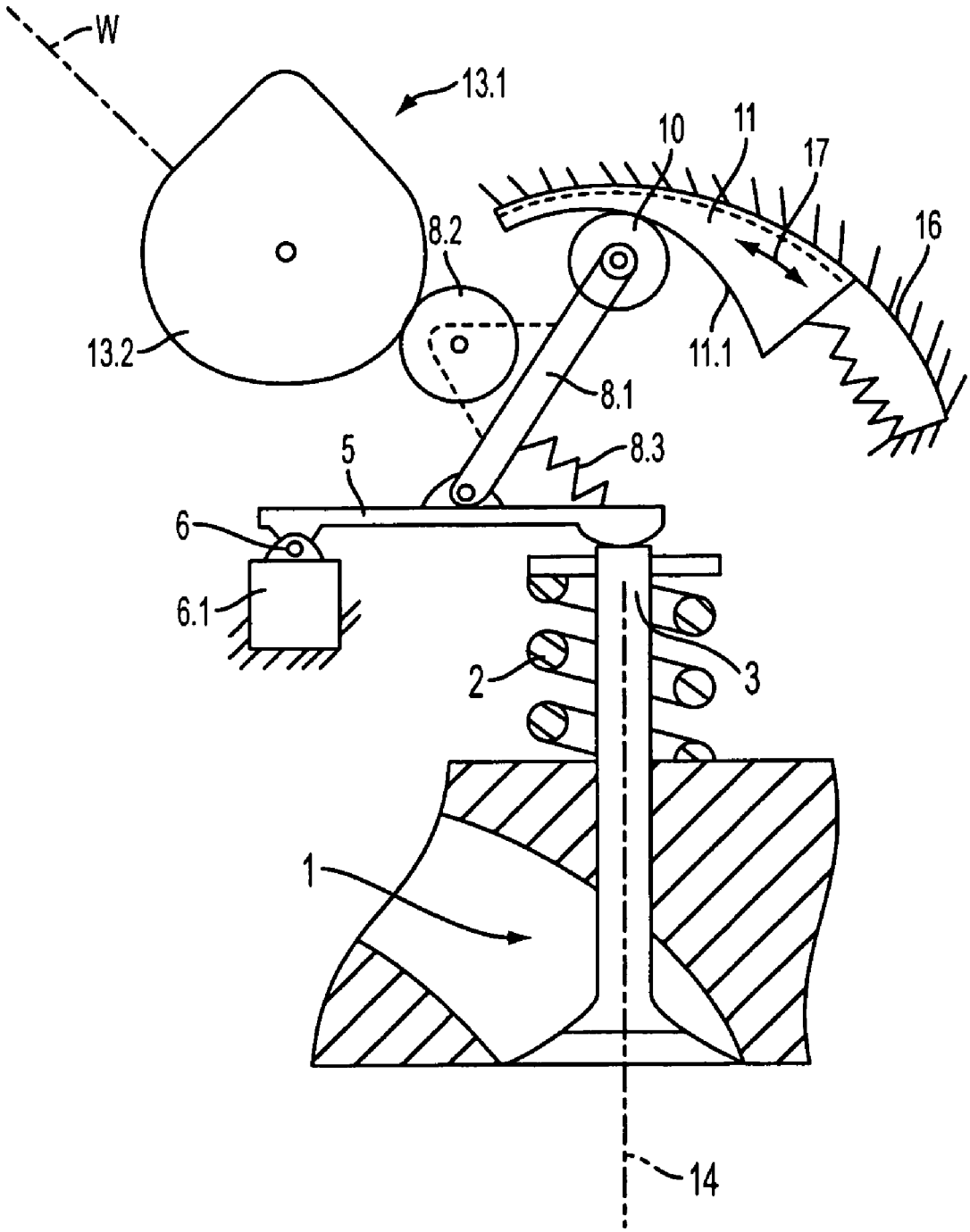
FIG. 10 shows an embodiment with reduced structural height.

FIG. 10 shows a schematic diagram of a modification of the embodiment according to FIG. 4. The pivoting lever 5 with its bearing 6 is supported on a valve play compensation element 6.1. A particularly favorable "package" with low structural height can be achieved by arranging the bearing below the cam mechanism 13.1. The spring element 8.3 in this case is designed as compression spring, so that the roll 8.2 is always pressed against the control contour of the cam 13.2.

FIG. 8 shows a schematic representation of an adjustment drive that can be used for adjusting the guide element 11 and is provided with a worm-gear toothing 20 that engages in an adjustment worm gear 22, which can be operated with an adjustment motor 21. The adjustment motor 21 is actuated via the engine control.

With a multi-cylinder piston engine, the adjustment mechanism for adjusting the guide element 11 can respectively be activated centrally for all gas intake valves and, if necessary, also for the gas exhaust valves. With so-called multiple valve engines, meaning if respectively two or more gas intake valves for each cylinder are provided, at least on the gas inlet side, one gas-reversing valve per cylinder advantageously should be allowed to operate in the standard way via a directly effective cam shaft with its full stroke and at least the second gas-reversing valve should be provided with the valve gear according to the invention, so that the stroke displacement of this gas-reversing valve can be adjusted according to the operating requirements from a zero stroke to a maximum stroke.

Figure 11:
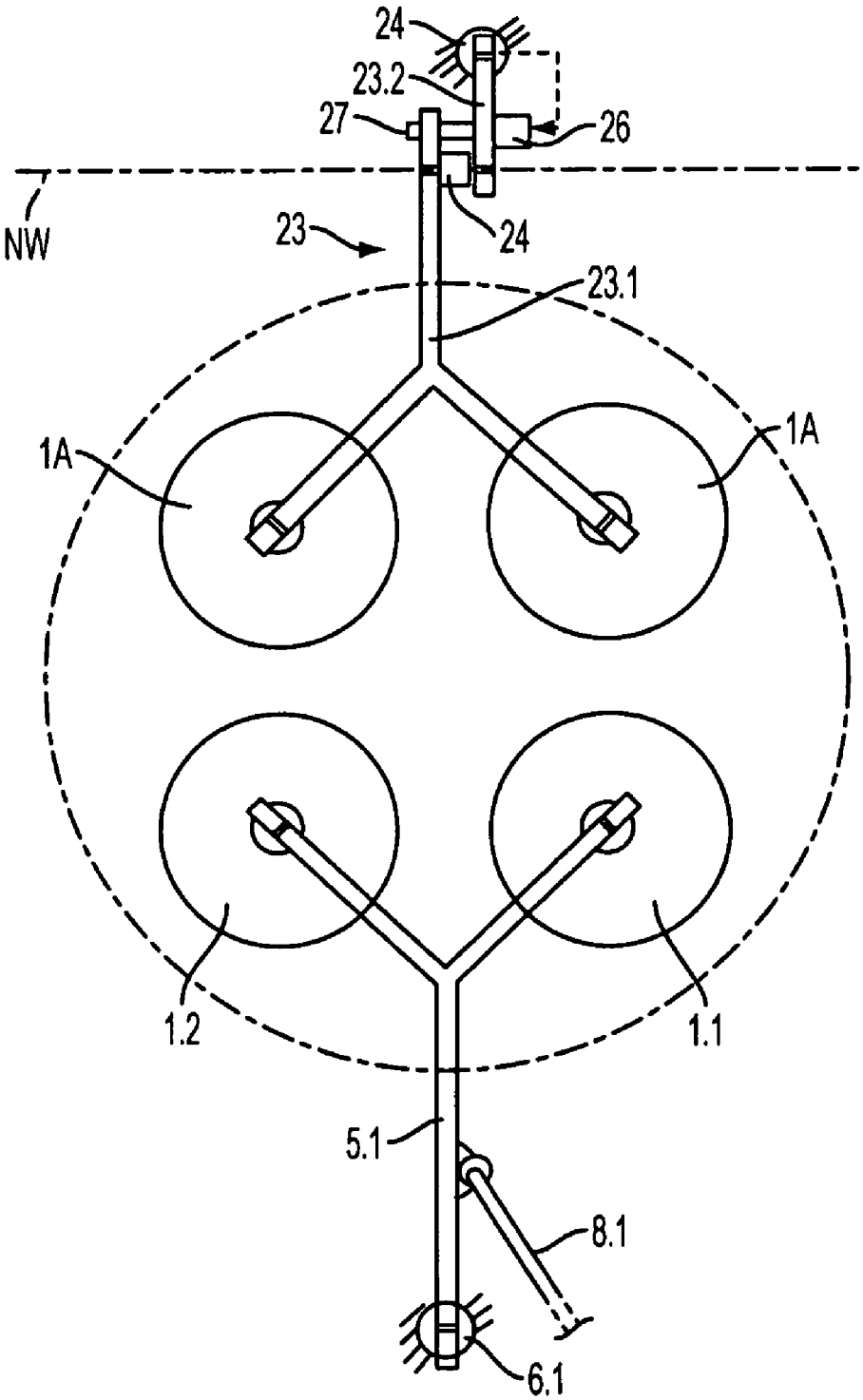
FIG. 11 is a schematic view from above of a cylinder with two intake valves and two exhaust valves.

As shown in FIG. 11 with a schematic view from above of a cylinder, it is possible to activate two intake valves 1.1 and 1.2 simultaneously with the aid of the aforementioned adjustment mechanism. For example, an adjustment mechanism as shown in FIG. 10 can be used, wherein the pivoting lever 5 shown in FIG. 10 is embodied as forked lever 5.1 in FIG. 11. The pivoting element 8.1 is hinged to this forked lever 5.1 as shown for the arrangement in FIG. 10. The pivoting element of this view from the top is pivoted out of the vertical plane to simplify the drawing The two exhaust valves 1A are activated via a forked drag lever 23 that is supported by a play compensation element 24 on the engine unit and is provided with a running roll 25, which is acted upon by the cam of a cam shaft NW (shown only with dash-dot line herein). The forked drag lever 23 shown in this exemplary embodiment is divided into two partial levers 23.1 and 23.2 that are joined so as to be articulated via the shaft of roll 25. The two partial levers 23.1 and 23.2 are connected via a controllable locking element with crossbar 27, such that for the locked position shown the two gas exhaust valves 1A can be operated in the standard way via the cam.

If the locking element 26 is activated and the crossbar 27 is pulled back, the two partial levers 23.1 and 23.2 are uncoupled, so that the cam will have the effect of "bending" the drag lever counter to the force of a restoring spring that is not shown in further detail herein and the gas exhaust valves 1A are therefore not opened.

If the locking element 26 is piston-cylinder unit, for example, and the crossbar 27 is connected to the piston, which in this case is held in the locked position with a compression spring that is not shown in further detail herein, the crossbar 27 can be pulled back counter to the force of the restoring spring to the unlocked position by administering oil pressure. The oil pressure can be supplied to the locking element 26 via the oil-pressure supply for the valve play compensation element 24, for example, and the respective channels in the partial lever 23.2.

If the operation of the exhaust valves for one cylinder or a group of cylinders is stopped with the aid of the engine control by opening the crossbar 27 and, simultaneously, the stroke-transfer means 4 on the intake side is adjusted to zero stroke, a so-called cylinder shutdown occurs, which is then associated via the engine control with a shutdown of the fuel supply and, if applicable, also a shutdown of the ignition.

If a single valve gear is used to operate two intake valves 1.1 and 1.2, as shown in FIG. 11, it is possible to divide the forked pivoting lever 5.1 accordingly in longitudinal direction to connect one partial lever with a pivoting element 8.1 and to provide a controllable locking element which makes it possible to operate both gas intake valves 1.1 and 1.2 simultaneously by locking the element and to stop the operation of one of the gas intake valves through unlocking it. Thus, only the one gas intake valve connected to the partial lever with hinged-on pivoting element 8.1 is activated.

By using a respective activation mechanism, it is possible with only one valve gear to activate either only one gas-reversing valve for a corresponding activation between zero stroke and maximum stroke, or both gas-reversing valves between zero stroke and maximum stroke.

With an arrangement having three gas intake valves, the pivoting lever 5 must be forked accordingly. A correspondingly division and the use of the locking mechanism in this case will also result in a pivoting lever design where alternately only one gas-reversing valve or all gas-reversing valves or, if necessary, the intake valves in their various assignments to each other can be operated jointly.

When designing the adjustment drive for guide elements in a multi-cylinder piston-type internal combustion engine, it is also possible and can be useful to provide at least some of the gas-reversing valves, particularly the gas intake valves, on each cylinder with the adjustment option. However, the arrangement can also be such that depending on the operating mode, a joint adjustment mechanism for the respective gas-reversing valves, particularly the gas intake valves, is provided for several individual cylinders or only for groups of cylinders.

However, it is also possible to have individual adjustment mechanisms, meaning each guide element is assigned an adjustment mechanism that can be actuated separately. Thus, not only the stroke of a gas-reversing valve can be adjusted fully variable as required, but individual variations are also possible with respect to the piston engine, at least for groups of cylinders in the piston-type internal combustion engine, based on corresponding individual variation options. The adjustment mechanisms in all cases are activated via an existing engine control. For this, it may be useful to have a translational movement of the guide element 11 in place of a pivoting movement.

Depending on the response speed of the adjustment mechanisms connected to the guide elements 11, it may also be useful to adjust a zero stroke within one intake stroke, for example for the gas intake valve or the compression stroke for a gas exhaust valve, or even induce a "mini stroke" following a brief "sensing operation" prior to the complete opening of the gas-reversing valve. A preceding mini stroke is useful for gas intake valves.

With a corresponding embodiment of the gas exhaust valves, it may be advantageous to actuate the gas-reversing valves in such a way that they are kept closed for a portion of the exhaust phase and only open briefly in the end phase of the exhaust stroke for the gas exhaust valve. This mode of operation is useful, for example, if the piston-type internal combustion engine functions as a whole as engine brake, for example by shutting down the fuel supply to the engine.

So-called valve crossovers can also be adjusted through a corresponding activation of the guide elements 11 on the gas intake side and the gas exhaust side, so that a phase where exhaust gas is taken in from the exhaust gas line, for example, is also possible with partially open exhaust valves and closed intake valves.

The use of the above-described valve gears is not limited to piston-type internal combustion engines, i.e. Otto engines or diesel engines, and also not to the above-described use of the cylinder shut-down. If the gas intake valves and the gas exhaust valves are respectively provided with the fully variable mechanical valve gear according to the invention, a braking operation can also be realized with corresponding actuation in that the gas exhaust valves are respectively opened only briefly before the upper dead point is reached if the fuel supply and the ignition are shut down for the compression stroke as well as the exhaust stroke.

The fully variable, mechanical valve gear according to the invention can also be used for operating at least the suction valves of a piston-type compressor for compacting gases. Forcibly controlling the valves on a piston-type compressor will result in a considerable improvement of the performance as compared to the standard plate-type valves designed as return valves. Since there are no buffering operations with the forced-control valves during the respective valve closings, no air is pushed back into the intake line during the transition to the compression stroke and compressed gas cannot flow back into the cylinders during the transition from the exhaust stroke to the suction stroke.

The cylinder filling and thus also the pressure increase can be changed purposely when using a fully variable valve gear according to the invention for activating the suction valves of piston-type compressors.

The use of the above-described valve gears is not limited to Otto engines, but can also be used with diesel engines, for example when used as engine brake.

The invention has been described in detail with respect to exemplary embodiments, and it will now be apparent from the foregoing to those skilled in the art, that changes and modifications may be made without departing from the invention in its broader aspects, and the invention, therefore, as defined in the appended claims, is intended to cover all such changes and modifications that fall within the true spirit of the invention.

What is claimed is:

1. A variably adjustable mechanical valve gear for at least one gas-reversing valve of a piston engine, comprising:

a driving mechanism for generating a lifting movement for the gas-reversing valve along a movement axis of the gas-reversing valve, the driving mechanism acting against a closing force of a closing spring on the gas-reversing valve; and a stroke transfer means arranged between the driving mechanism and the gas-reversing valve, said stroke transfer means acting upon the gas-reversing valve to move the gas-reversing valve along the movement axis, the stroke transfer means comprising:

an adjustable guide element having a control curve for adjusting a stroke distance of the gas-reversing valve along the movement axis;

a pivoting element having a first end connected to the driving mechanism and guided to pivot on the adjustable guide element, and a second end acting upon the gas-reversing valve; and a guide member separate from the adjustable guide element, wherein the guide member is locally fixed to the engine, and is connected to the second end of the pivoting element to support movement of the pivoting element.

2. The valve gear according to claim 1, wherein the resulting line of action for the adjustment force of the driving mechanism is effective at an angle to the movement axis of the gas-reversing valve.

3. The valve gear according to claim 1, wherein the adjustable guide element is connected to an adjustment mechanism.

4. The valve gear according to claim 1, wherein the second end of the pivoting element is connected to the gas-reversing valve via a pivoting lever that is locally fixed to the engine.

5. The valve gear according to claim 1 and used for activating at least two side-by-side arranged gas-reversing valves wherein the stroke transfer means has a forked pivoting lever, the fork ends of which respectively act upon one gas-reversing valve.

6. The valve gear according to claim 5, wherein the forked pivoting lever is formed with partial levers, arranged parallel and side-by-side, which are positioned so as to pivot independent of each other and that a controllable locking mechanism that is effective between the partial levers is provided, so that optionally both gas-reversing valves or only one gas-reversing valve can be activated with the stroke transfer means.

7. The valve gear according to claim 1, wherein the second end of the pivoting element is positioned on a locally fixed sliding guide and is connected to the gas-reversing valve.

8. The valve gear according to claim 11, wherein the guide element with its control curve is positioned on the piston engine such that it can be pivoted around an axis that extends crosswise to the movement axis of the gas-reversing valve.

9. The valve gear according to claim 1, wherein the control curve is designed such that with a constant stroke displacement for the driving mechanism, a lifting distance between a zero lift and a maximum lift can be adjusted.

10. The valve gear according to claim 1, wherein the control curve consists of a basic circle relative to the pivoting axis as "zero lift zone" I and a following adjustment curve as "lift zone" II, wherein the length of the basic circle as measured in circumferential direction corresponds at least to that of the pivoting distance corresponding to the stroke displacement for the driving mechanism.

11. The valve gear according to claim 1, wherein the driving mechanism is a crank mechanism that acts upon the stroke transfer means.

12. The valve gear according to claim 1, wherein the driving mechanism is a cam mechanism that acts upon the stroke transfer means.

13. The valve gear according to claim 1, wherein an electromagnetic or a hydraulic actuator functions as the driving mechanism.

14. The valve gear of claim 1, wherein the piston engine is an internal combustion engine.

15. A variably adjustable mechanical valve gear for activating at least two side-by-side arranged gas-reversing valves of a piston engine, comprising:

a driving mechanism for generating a lifting movement for a gas-reversing valve along a movement axis of the gas-reversing valve, the driving mechanism acting against a closing force of a closing spring on the gas-reversing valve; and a stroke transfer means arranged between the driving mechanism and the gas-reversing valve, said stroke transfer means acting upon the gas-reversing valve to move the gas-reversing valve along the movement axis, the stroke transfer means comprising:

an adjustable guide element having a control curve for adjusting a stroke distance of the gas-reversing valve along the movement axis;

a pivoting element having a first end connected to the driving mechanism and guided to pivot on the adjustable guide element, and a second end acting upon the gas-reversing valve;

a forked pivoting lever, the fork ends of which respectively act upon one of the at least two gas-reversing valves; and a guide locally fixed to the engine, wherein the pivoting element is positioned on the guide and the guide supports movement of the pivoting element.

16. The valve gear according to claim 15, wherein the forked pivoting lever is formed with partial levers, arranged parallel and side-by-side, which are positioned so as to pivot independent of each other and that a controllable locking mechanism that is effective between the partial levers is provided, so that optionally both gas-reversing valves or only one gas-reversing valve can be activated with the stroke transfer means.

17. A variably adjustable mechanical valve gear for at least one gas-reversing valve of a piston engine, comprising:

a driving mechanism for generating a lifting movement for a gas-reversing valve along a movement axis of the gas-reversing valve, the driving mechanism acting against a closing force of a closing spring on the gas-reversing valve; and a stroke transfer means arranged between the driving mechanism and the gas-reversing valve, said stroke transfer means acting upon the gas-reversing valve to move the gas-reversing valve along the movement axis, the stroke transfer means comprising:

an adjustable guide element having a control curve for adjusting a stroke distance of the gas-reversing valve along the movement axis;

a pivoting element having a first end connected to the driving mechanism and guided to pivot on the adjustable guide element, and a second end acting upon the gas-reversing valve; and a sliding guide locally fixed to the engine and adapted to support movement of the pivoting element, wherein the second end of the pivoting element is positioned on the sliding guide and is connected to the gas reversing valve.

18. A variably adjustable mechanical valve gear for at least one gas-reversing valve of a piston engine, comprising:

a driving mechanism for generating a lifting movement for the gas-reversing valve along a movement axis of the gas-reversing valve, the driving mechanism acting against a closing force of a closing spring on the gas-reversing valve; and a stroke transfer means arranged between the driving mechanism and the gas-reversing valve, said stroke transfer means acting upon the gas-reversing valve to move the gas-reversing valve along the movement axis, the stroke transfer means comprising:

an adjustable guide element having a control curve for adjusting a stroke distance of the gas-reversing valve along the movement axis;

a pivoting element having a first end connected to the driving mechanism and guided to pivot on the adjustable guide element, and a second end acting upon the gas-reversing valve; and a guide locally fixed to the engine, wherein the pivoting element is positioned on the guide and the guide supports movement of the pivoting element;

wherein the control curve consists of a basic circle relative to the pivoting axis as "zero lift zone" I and a following adjustment curve as "lift zone" II, wherein the length of the basic circle as measured in circumferential direction corresponds at least to that of the pivoting distance corresponding to the stroke displacement for the driving mechanism.

* * * * *